US011981467B2

(12) United States Patent
Yu et al.

(10) Patent No.: US 11,981,467 B2
(45) Date of Patent: May 14, 2024

(54) APPARATUS AND METHOD FOR IMPORTING FLUID, METHOD FOR TEARING FILM, AND AIR EXTRACTING DEVICE

(71) Applicant: SHENZHENSHI YUZHAN PRECISION TECHNOLOGY CO., LTD., Shenzhen (CN)

(72) Inventors: Hui-Tse Yu, New Taipei (TW); Chen-Yu Hong, New Taipei (TW); Zhi-Chao Xu, Shenzhen (CN); Ya-Wei Zeng, Shenzhen (CN)

(73) Assignee: SHENZHENSHI YUZHAN PRECISION TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/693,639

(22) Filed: Mar. 14, 2022

(65) Prior Publication Data

US 2022/0289410 A1 Sep. 15, 2022

(30) Foreign Application Priority Data

Mar. 15, 2021 (CN) ..... 202110276314.4

(51) Int. Cl.

| | |
|---|---|
| ***B65B 3/18*** | (2006.01) |
| ***B65B 31/04*** | (2006.01) |
| ***B65B 3/04*** | (2006.01) |

(52) U.S. Cl.

CPC ..... *B65B 3/18* (2013.01); *B65B 3/04* (2013.01); *B65B 31/04* (2013.01)

(58) Field of Classification Search

CPC ..... H05K 5/0091; B25J 21/02; B65B 11/52; B65B 3/003; B65B 55/027; B65B 25/067; B65B 55/02; B65B 7/2821; B65D 2205/00; B65D 2205/025; B65D 77/225; B65D 81/3453; B65D 81/2076

See application file for complete search history.

(56) References Cited

U.S. PATENT DOCUMENTS

| | | | | |
|---|---|---|---|---|
| 5,000,816 | A * | 3/1991 | Seki | G03F 7/161 156/707 |
| 2011/0046771 | A1* | 2/2011 | Alms | B29C 70/546 700/114 |
| 2018/0093814 | A1* | 4/2018 | Espinosa | A23L 3/28 |
| 2018/0346171 | A1* | 12/2018 | Kua | B65B 11/50 |

* cited by examiner

*Primary Examiner* — Veronica Martin
(74) *Attorney, Agent, or Firm* — ScienBiziP, P.C.

(57) ABSTRACT

An apparatus and a method for importing fluid, and a method for tearing film are provided. The apparatus imports fluid into a product and tears a breathable film covered on the product, the product defines a vent in a surface, the breathable film covers on the vent. The apparatus includes a transfer assembly and a controller. The breathable film is connected to the transfer assembly. The controller is coupled to the transfer assembly and configured to control the transfer assembly to vertically move relative to the surface of the product to tear the breathable film from the vent.

20 Claims, 9 Drawing Sheets

APPARATUS AND METHOD FOR IMPORTING FLUID, METHOD FOR TEARING FILM, AND AIR EXTRACTING DEVICE

CROSS-REFERENCE TO RELATED APPLICATIONS

This application claims priority to Chinese Patent Application No. 202110276314.4 filed on Mar. 15, 2021 in China National Intellectual Property Administration, the contents of which are incorporated by reference herein.

FIELD

The subject matter herein generally relates to manufacturing processes, and particularly to an apparatus and a method for importing fluid, a method for tearing film, and an air extracting device.

BACKGROUND

In the field of manufacturing and processing, importing impact-absorbing material in fluid form into interior of products improves resistance to impacts in service and durability. During the importing process, the fluid is normally thick and sticky, and releasing or extracting air from the internal space of the product by an air extractor when importing the fluid improves the flow of the fluid in small spaces. To prevent the fluid entering the air extractor when air is removed, a film is attached to areas of the air extractor contacting the product, the film allows air to pass through but prevents fluid passing through and entering the air extractor.

However, attaching and tearing away the film by manual operation is fiddly and imprecise. The manual attachment of the film is also difficult and costly in terms of manual operators. Besides, the fluid sticking to the back of the film may easily rub off or transfer to a surface of the product when tearing the film, polluting the product and later processes.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Implementations of the disclosure will now be described, by way of embodiments only, with reference to the drawings. The disclosure is illustrative only, and changes may be made in the detail within the principles of the present disclosure. It will, therefore, be appreciated that the embodiments may be modified within the scope of the claims.

Unless otherwise defined, all technical terms used herein have the same meaning as commonly understood by one of ordinary skill in the art. The technical terms used herein are to provide a thorough understanding of the embodiments described herein but are not to be considered as limiting the scope of the embodiments.

Several definitions that apply throughout this disclosure will now be presented.

The term "coupled" is defined as connected, whether directly or indirectly through intervening components, and is not necessarily limited to physical connections. The term "substantially" is defined to be essentially conforming to the particular dimension, shape or other word that the term modifies, such that the component need not be exact. The term "comprising," when utilized, means "including, but not necessarily limited to", it specifically indicates open-ended inclusion or membership in the so-described combination, group, series, and the like.

Figure 1:
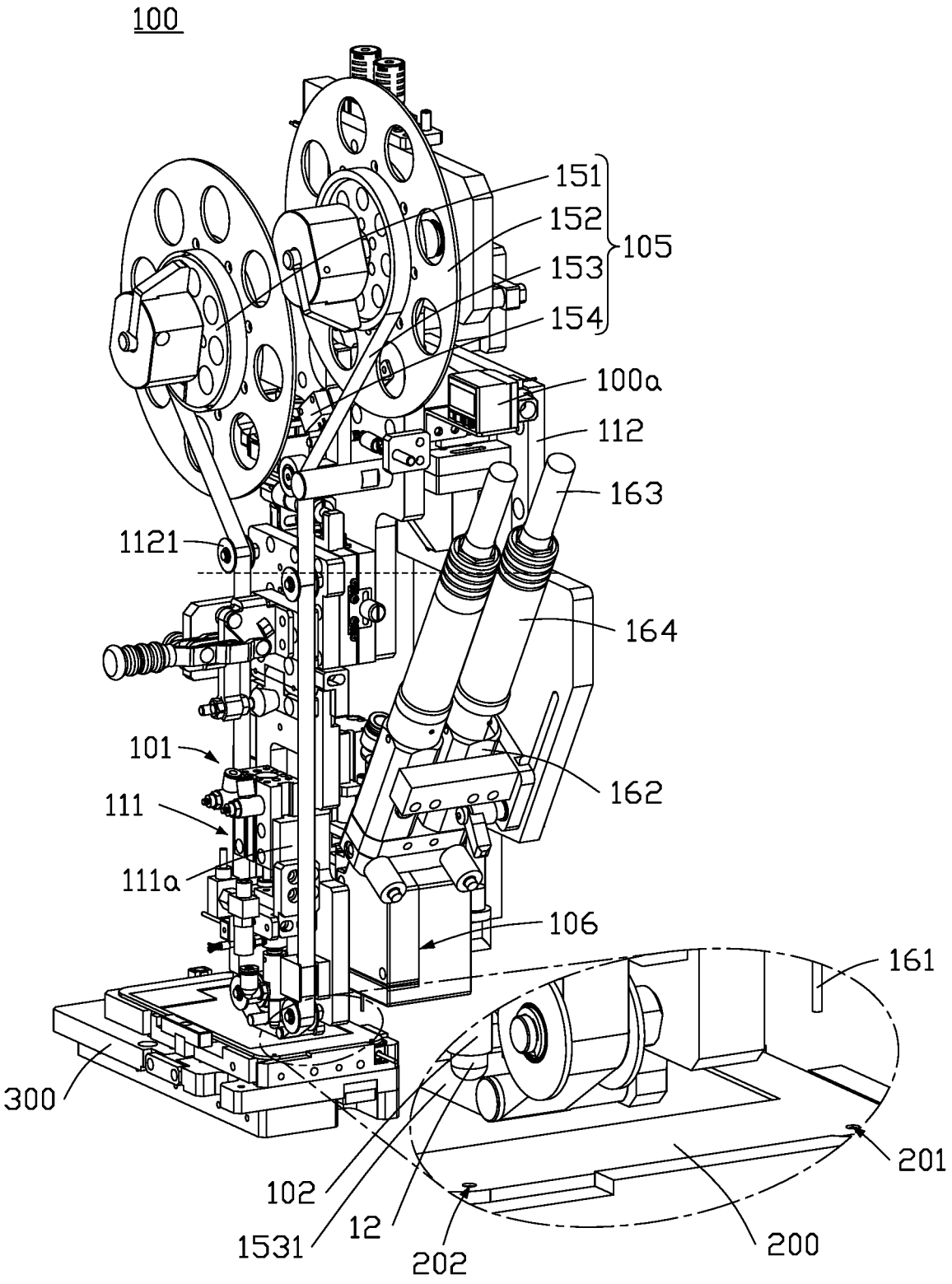
FIG. 1 illustrates a schematic diagram of at least one embodiment of an apparatus for importing fluid.
Figure 2:
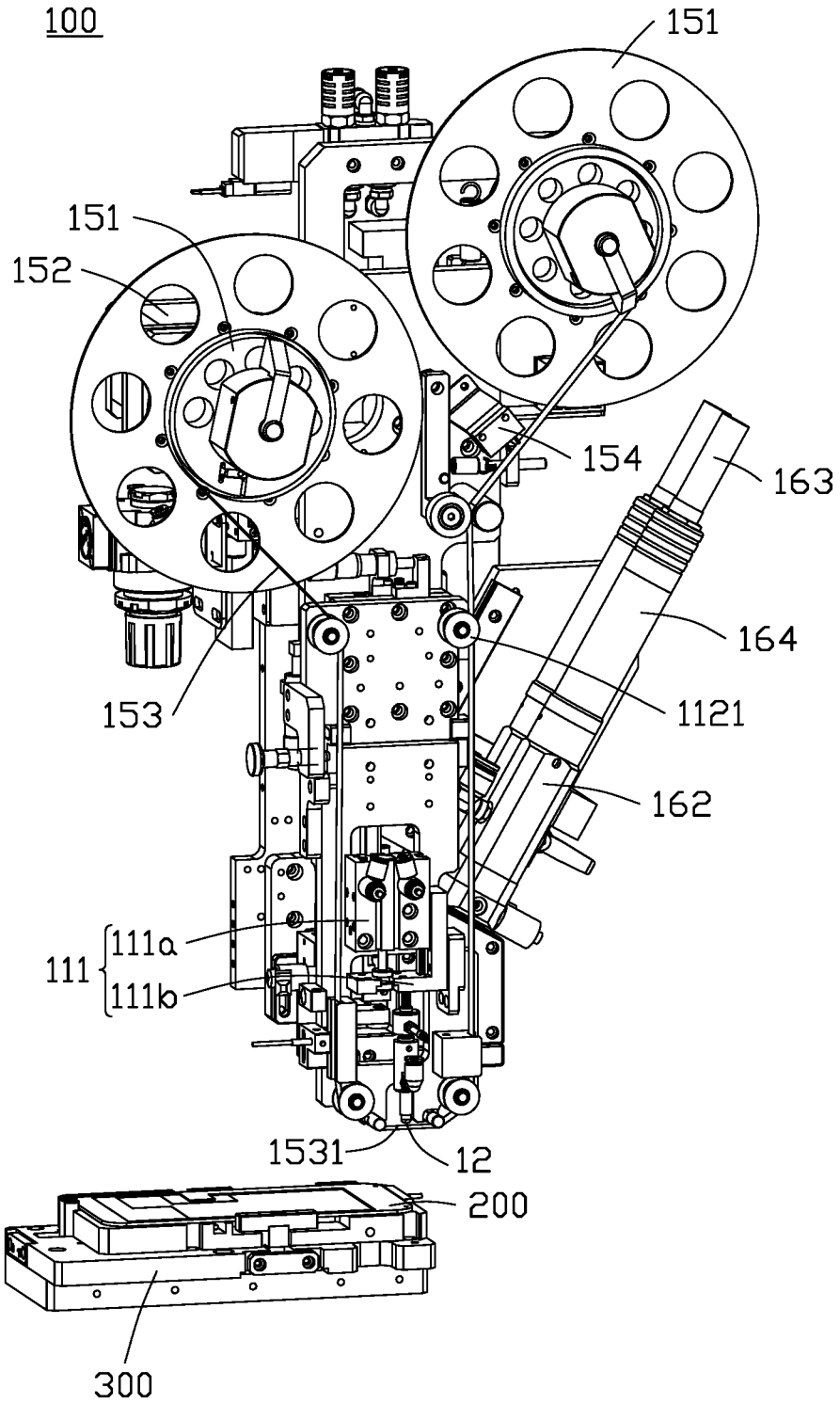
FIG. 2 illustrates another schematic diagram of at least one embodiment of the apparatus of FIG. 1.
Figure 3:
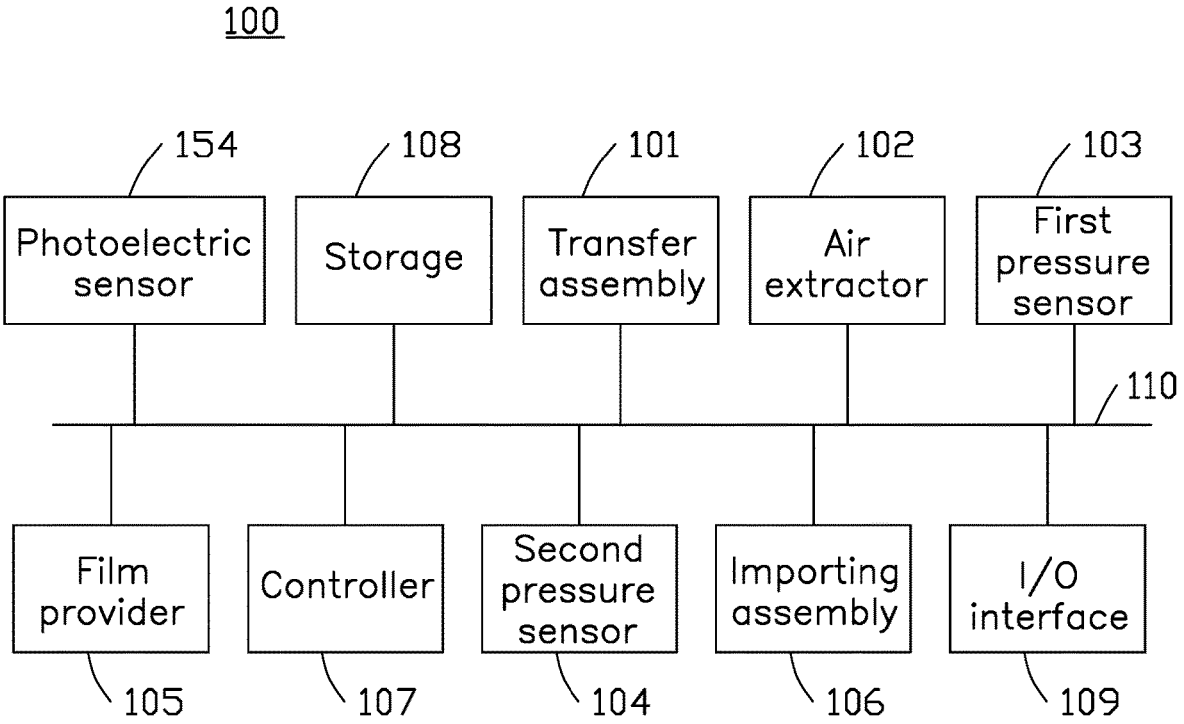
FIG. 3 illustrates a functional block diagram of at least one embodiment of the apparatus.
Figure 4:
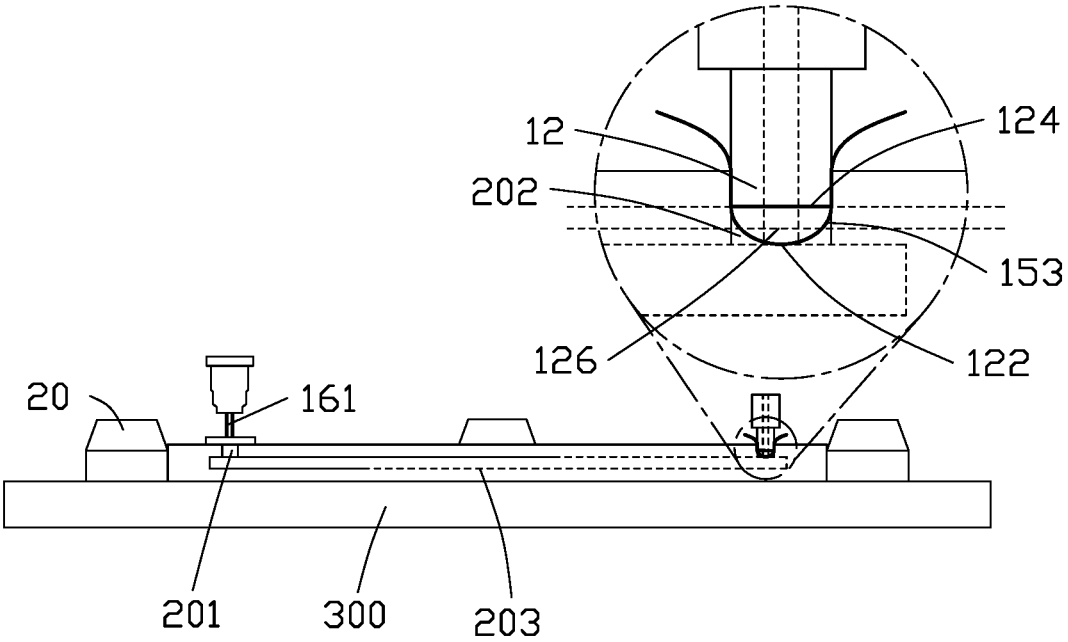
FIG. 4 illustrates a plan view of at least one embodiment of the apparatus.

FIGS. 1 and 2 illustrate schematic diagrams of at least one embodiment of an apparatus 100 for importing fluid. FIG. 3 illustrates a functional block diagram of at least one embodiment of the apparatus 100. FIG. 4 illustrates a plan view of at least one embodiment of the apparatus 100. The apparatus 100 is configured to import fluid into a chamber 203 of a product and remove a gas-porous membrane ("breathable film") on a vent 202 of the product 200 after completion of importing fluid.

The product 200 includes an import hole 201, the vent 202, and the chamber 203. The import hole 201 and the vent 202 are communicating with the chamber 203. The vent 202 is defined on a surface of the product 200. The product 200 is placed in a predetermined position of a workbench 300 before importing fluid into the product 200. A securing assembly 20 is arranged on the workbench 300 for securing the product 200, so as to maintain the product 200 in the predetermined position of the workbench 300 during importing of fluid into the product 200. In at least one embodiment, a quantity of import holes 201 may be equal to a quantity of vents 202, or one import hole 201 may correspond to several vents 202, and vice versa. For instance, the import hole 201 includes one import hole 201 corresponding to one vent 202, one import hole 201 corresponding to two vents 202, or two import holes 201 corresponding to one vent 202.

As illustrated in FIGS. 1-3, the apparatus 100 includes a transfer assembly 101, an air extractor 102, a first pressure sensor 103, a second pressure sensor 104, a film provider 105, an importing assembly 106, and the workbench 300.

The importing assembly 106 includes an import head 161 for importing fluid into the chamber 203 through the import hole 201. In at least one embodiment, the import head 161 may be a needle. In other embodiments, the import head 161 may be a pipe. The importing assembly 106 further includes a glue mixing pipe (not shown) and a glue mixing valve 162 connected to the glue mixing pipe. The glue mixing pipe is connected to the needle and configured to mix different fluids. The glue mixing valve 162 is configured to switch the glue mixing pipe on and off. The importing assembly 106 further includes a fluid valve (not shown) connected to the import head 161 and configured to control the import head 161 between on and off. In at least one embodiment, the fluid valve may be a flow control valve for controlling on/off state of the import head 161 and a flow speed.

In at least one embodiment, the importing assembly 106 further includes a first driver 163 and a delivery pipe 164 connected to the import head 161. The delivery pipe 164 includes helical impellers ("delivery screws", not shown). The first driver 163 connects to the delivery screws to rotate the delivery screws, so as to drive the fluid in the delivery pipe 164 to flow towards the import head 161. The first driver 163 may be a motor. A rate of rotation of the delivery screws is controllable by controlling a rate of rotation of the first driver 163, so as to control the flow speed of the fluid into the chamber 203.

The air extractor 102 includes an extract head 12, which may engage with the breathable film. The air extractor 102 is configured to press the breathable film onto the vent 202 and extract air from the chamber 203 through the vent 202, thus the chamber 203 forms a negative pressure environment, which imports the fluid by suction. The air extractor 102 further includes a motor (not shown) connected to the extract head 12 for generating power for extracting air from the chamber 203. The breathable film is water- and fluid-proof, on one hand, the extract head 12 extracts air from the chamber 203 through the breathable film, on the other hand, the breathable film prevents fluid in the chamber 203 overflowing through the vent 202.

In at least one embodiment, the transfer assembly 101 is connected to the breathable film and configured to vertically move to a surface of the product 200, so the breathable film is pressed to or separated from the vent 202. On one hand, before extracting the air, the transfer assembly 101 drives the breathable film towards the surface of the product 200 to press the breathable film to the vent 202. On the other hand, after importing the fluid, the transfer assembly 101 removes the breathable film from the surface of the product 200 by tearing the breathable film. To separate the breathable film from the vent 202, the transfer assembly 101 vertically moves away from the surface of the product 200, which may prevent the fluid remaining in or on the breathable film and reducing probability of the fluid being transferred to the surface of the product 200. Even though some fluid remains in or on the breathable film, under the action of gravity, the fluid may flow into the vent 202, but not overflow to the surface of the product 200 through sidewalls.

The surface of the product 200 may be a plane or an irregular surface. When the surface of the product 200 is a plane, the transfer assembly 101 vertically moves relative to the surface of the product 200. When the surface of the product 200 is irregular, the transfer assembly 101 vertically moves tangentially relative to plane of the irregular surface.

In at least one embodiment, the transfer assembly 101 connecting to the breathable film means that the breathable film is movable with the transfer assembly 101, the breathable film and the transfer assembly 101 do not move in relation to each other when in operation. In detail, when the transfer assembly 101 moves towards the product 200, the breathable film also moves towards the product 200. When the transfer assembly 101 moves away from the product 200, the breathable film also moves away from the product 200. The breathable film may be arranged on the transfer assembly 101 or on one portion of the transfer assembly 101.

In other embodiments, the transfer assembly 101 is further configured to drive the breathable film to move along a first direction, so the breathable film separates from the vent 202. The first direction may be corresponding to or parallel to an axis of the import head 161. In addition, the transfer assembly 101 is further configured to drive the breathable film to move along a second direction, so the breathable film approaches the vent 202. The second direction may be corresponding to or parallel to an axis of the import head 161. That is, the second direction is parallel to the first direction, but opposite. Since the extraction direction is along the axis of the import head 161, the import head 161 fits the product 200, when the transfer assembly 101 drives the breathable film to move along the first direction, this prevents the fluid moving with the breathable film, so as to reduce probability of pollution on the product 200.

In other embodiments, the transfer assembly 101 connects to the extract head 12 and the breathable film. On one hand, when the apparatus 100 starts, the transfer assembly 101 moves towards the vent 202, meanwhile drives the extract head 12 to move towards the vent 202, the extract head 12 presses to the vent 202 and the breathable film, so the breathable film is pressed to the vent 202, that is, the breathable film is between the extract head 12 and the vent 202, thus no extra process of sticking film is needed. On the other hand, after importing the fluid, the transfer assembly 101 moves away from the vent 202, meanwhile drives the extract head 12 to move away from the vent 202, so as to tear off the breathable film, that is, the tearing off is operated while the extract head 12 is moving away from the vent 202, no extra process of tearing film is needed. Compared to traditional sticking and tearing off process, separate sticking film station and tearing film station may be omitted, saving time for importing the fluid and increasing an efficiency of importing the fluid and a usage ratio of the apparatus 100.

In other embodiments, the transfer assembly 101 connects to the extract head 12, and the breathable film. On one hand, when the apparatus 100 is activated, the transfer assembly 101 moves towards the vent 202, while the extract head 12 and the breathable film are moved towards the vent 202, and the import head 161 moved towards the import hole 201, the extract head 12 presses to the vent 202 and the breathable film, thus no extra processes for sticking film are needed. That is, the transfer assembly 101 moving towards the vent 202 accomplishes at least three tasks: to move the import head 161 to the import hole 201 for importing fluid into the chamber 203, to press the breathable film to the vent 202, and to cover the extract head 12 to the vent 202 for extracting air through the breathable film and the vent 202. On the other hand, after importing the fluid, the transfer assembly 101 moves away from the vent 202, meanwhile drives the extract head 12 and the import head 161 to move away from the product 200, so as to tear off the breathable film. That is, the transfer assembly 101 moving away from the product 200 does three things: to move import head 161 away from the import hole 201, to tear off the breathable film, to move the extract head 12 away from the vent 202, and no extra processes for tearing film are needed. Comparing to traditional sticking and tearing film process, separate sticking film station and tearing film station may be omitted, which may save a time for importing the fluid and increase an efficiency of importing the fluid and a use ratio of the apparatus 100.

In at least one embodiment, the actions of apparatus 100 mean that the product 200 keeps still, and the transfer assembly 101 drives the breathable film to move. In other embodiments, the moving means that the product 200 moves, but the transfer assembly 101 keeps still. In other embodiments, the product 200 may be positioned in a movable portion, while the transfer assembly 101 keeps still. The movable portion in a direction perpendicular to the surface of the product and away from the breathable film, thus the product 200 may be separated from the breathable film, so as to tear off the breathable film, thus no extra processes are needed before or after unloading the product 200.

In other embodiments, the transfer assembly 101 includes a press head (not shown). The transfer assembly 101 is configured to moves towards the surface of the product 200, so the press the breathable film to cover the vent 202. Thus, the breathable film is for allowing escape of air and stopping the fluid, so as to prevent leaking of the fluid from the vent 202. After pressing of the breathable film by the press head, the extract head 12 presses the breathable film, so the process of extracting air of the importing fluid operation is accomplished.

In at least one embodiment, the transfer assembly 101 includes a slide assembly 111 and a shelf 112. The shelf 112 is connected on the slide assembly 111. The slide assembly 111 is connected to the extract head 12 and configured to drive the air extractor 102 to move vertically relative to the product 200. The first pressure sensor 103, the film provider 105, and the extract head 12 are connected to the shelf 112. The shelf 112 drives the extract head 12 and the breathable film.

The slide assembly 111 includes a slide driver (not shown) and a slide shelf 111*a*. The slide shelf 111*a* is slidably connected to the slide driver. The shelf 112 is connected to the slide shelf 111*a*. The shelf 112 is connected to extract head 12 or the press head. The slide driver drives the slide shelf 111*a* and further drives the shelf 112 to vertically move relative to the surface of the product 200 (such as towards or away from the product 200), so the air extractor 102 or the press head press the breathable film to the vent 202 or tear the breathable film away from the vent 202. In at least one embodiment, the slide driver may include a motor and a screw. The motor drives the screw to rotate. The slide shelf 111*a* is secured on the screw. In other embodiments, the slide driver may be a rack driver, a cylinder driver, or a belt driver.

Referring to FIG. 4, the extract head 12 includes an air inlet positioned in a bottom of the extract head 12, that is a portion of the extract head 12 connecting to external device or structure (such as the vent 202 of the product 200 in at least one embodiment). The air inlet is connected to a pneumatic device and configured to extract air from the chamber 203 through the vent 202 when the air inlet is pressed to the breathable film.

Cutting the extract head 12 in a direction perpendicular to the axis of the extract head 12, thereby forming a first cross section 124 and a second cross section 126 in parallel. The second cross section 126 is between the first cross section 124 and the air inlet, an area of the first cross section 124 is greater than an area of the second cross section 126, the area of the first cross section 124 is greater than an area of the air inlet 122. Thus, a periphery of the extract head 12 is increasing from one end with the air inlet 122 to other end, when the extract head 12 presses to the breathable film, a part of the extract head 12 with an outer radius smaller than the vent 202 may be inserted into the vent 202, so as to improve airtightness when the extract head 12 presses the breathable film on. In at least one embodiment, the first cross section 124 and the second cross section 126 are virtual cross sections, which describes the structure of the extract head 12.

In at least one embodiment, the extract head 12 protrudes and forms an arc shape. That is an outer periphery of the extract head 12 is substantially an arced structure. Due to error in the product 200, positions of the extract head 12 and the vent 202 in a vertical direction have micro errors. When the extract head 12 moves towards the vent 202, the protruded arc structure of the extract head 12 slides along an internal wall of the vent 202, thus the extract head 12 slides into the vent 202, thereby facilitating the positioning and times of the extract head 12, no extra positioning devices are needed, and improving a precision and convenience of sealing the breathable film. Besides, the air inlet of the extract head 12 is positioned in the vent 202, so the fluid may not overflow through the breathable film to the surface of the product 200. In other embodiments, the extract head 12 protrudes and forms a taper or an elliptical shape.

In at least one embodiment, the extract head 12 further includes an elastic portion (not shown) surrounding the air let. When the elastic portion closes the vent 202, the elastic portion may elastically contact the vent 202. When the extract head 12 move towards the vent 202 together with the transfer assembly 101, the extract head 12 elastically deforms, forming a space, which is good for positioning the extract head 12 to the vent 202 and improving the airtightness between the extract head 12 and the vent 202. A hard or impactful contact between the extract head 12 and the vent 202 may be prevented, so as to protect the product 200.

In at least one embodiment, a part of outer radius of the elastic portion is greater than an inner diameter of the vent 202, thus when the elastic portion of the extract head 12 moves towards the vent 202, the elastic portion and a wall of the vent 202 is squeezed by the transfer assembly 101, the elastic portion deforms into the vent 202. Thus, the airtightness of the extract head 12 pressing the breathable film is improved, and external air prevented from entering the chamber 203 and fluid overflowing out of the chamber 203.

The first pressure sensor 103 is configured to detect a pressure of the extract head 12 pressing to the breathable film to generate a first pressure value. The transfer assembly 101 adjusts a position of the extract head 12 according to the first pressure value. In at least one embodiment, the first pressure sensor 103 has a predetermined threshold value, within a predetermined threshold value range, the extract head 12 clinging to the vent 202 is determined. The predetermined threshold value range may be about 0.8-3 Newton (N). When the first pressure sensor 103 detects a value smaller than 0.8 N, the transfer assembly 101 continuously drives the extract head 12 to move towards (continuously presses) the vent 202, until the value reaches the predetermined threshold value range of 0.8-3 N. When the first pressure sensor 103 detects a value greater than 0.4 g, the transfer assembly 101 drives the extract head 12 to move away from (releases) the vent 202, until the value reaches the predetermined threshold value range of 0.8-3 N. Therefore, the product 200 is protected from over pressure.

The second pressure sensor 104 includes a detector (not shown) for detecting a pressure in the chamber 203 of the product 200 to generate a second pressure value. In at least one embodiment, the second pressure sensor 104 is close to the extract head 12 for decreasing errors, thus the second pressure value is close to a real pressure value in the chamber 203. The second pressure sensor 104 may be a digital sensor, which replaces an air pipe with an electronic signal wire for detecting the second pressure value, so as to improve a response speed and accuracy of the pressure signal. In other embodiments, the second pressure sensor 104 may be an air sensor. A detecting frequency of the second pressure sensor 104 is adjustable, such as detections at every 0.01 second.

In at least one embodiment, the first pressure sensor 103 and the second pressure sensor 104 can be integrated as a pressure sensor including two detectors, one for detecting pressure in the chamber 203 and the other one for detecting the pressure of the extract head 12 pressing the breathable film.

The film provider 105 is configured to provide a tape feeder 153. The breathable film is on the tape feeder 153. The film provider 105 includes a tray holder 151, a roller 152, and at least one guide wheel 1121. The tray holder 151 and the roller 152 are arranged on the shelf 112. The tray holder 151 holds the tape feeder 153. The roller 152 drives the tray holder 151 together with the tape feeder 153 to rotate. The guide wheel 1121 guides the tape feeder 153 to carry the breathable film on the tape feeder 153 to above the vent 202. In other embodiments, positions of the roller 152 and the tray holder 151 can be exchanged.

Figure 5:
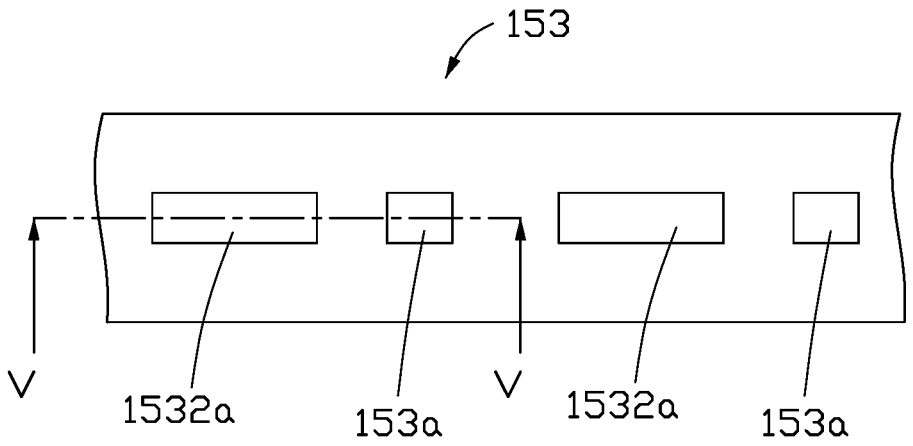
FIG. 5 illustrates a plan view of at least one embodiment of a tape feeder of the apparatus.
Figure 6:
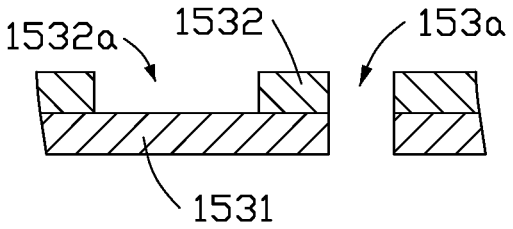
FIG. 6 illustrates a sectional view of at least one embodiment of the tape feeder along line V-V of FIG. 5.

Referring to FIGS. 5 and 6, the tape feeder 153 includes a breathable film 1531 and a base layer 1532. The breathable film 1531 is overlapped on the base layer 1532. The base layer 1532 defines a plurality of first holes 1532*a* arranged alternately (the first hole 1532*a* throughout the base layer 1532), every two neighboring first holes 1532*a* have a same distance. The first hole 1532*a* exposes the breathable film 1531. When the extract head 12 presses the breathable film 1531 on the vent 202, the extract head 12 extracts air from the chamber 203 through the first hole 1532*a*, the breathable film 1531, and the vent 202. The tape feeder 153 defines a plurality of second holes 153*a*. Every two neighboring second holes 153*a* have a same distance. The second holes 153*a* are throughout the breathable film 1531 and the base layer 1532 and configured to position the tape feeder 153 through a photoelectric sensor. The second holes 153*a* and the first holes 1532*a* are arranged one by one, that is on opposite sides of each first hole 1532*a* there are two second holes 153*a*.

The film provider 105 further includes a photoelectric sensor 154 mounted on the shelf 112 and configured to detect positions of the tape feeder 153 by reflection of light. In detail, during the tape feeder 153 moves, the photoelectric sensor 154 receives reflection of light from the tape feeder 153, when the photoelectric sensor 154 receives reflection of light from the first holes 1532*a* or other positions of the tape feeder 153, due to the first holes 1532*a* covered by the breathable film 1531, other positions of the tape feeder 153 are not throughout, the photoelectric sensor 154 receives a much greater reflection of light. The tape feeder 153 keeps rotating, when the second holes 153*a* are in detecting positions of the photoelectric sensor 154, due to the second holes 153*a* throughout the tape feeder 153 and being hollow, the photoelectric sensor 154 receives small (or zero) reflection of light, the tape feeder 153 stops rotating, so as to ensure that the breathable film 1531 covers the first holes 1532*a* below the extract head 12. That is, the photoelectric sensor 154 determines the position of the tape feeder 153 by receiving light which is reflected.

In other embodiments, the tape feeder 153 may only define the first holes 1532*a* for exposing the breathable film 1531 to receive pressure from the extract head 12 and positioning the tape feeder 153 through the photoelectric sensor (reflection of the photoelectric sensor on the first holes 1532*a* is not corresponding to reflection of other positions of the tape feeder 153). In at least one embodiment, the breathable film 1531 may be made of elastic material, when the extract head 12 extracts air and presses on the breathable film 1531, the breathable film 1531 elastically presses the vent 202, so parts of the breathable film 1531 corresponding to the vent 202 protrudes towards the interior of the vent 202, so as to improve airtightness of the breathable film 1531 and prevent fluid overflows.

In at least one embodiment, the film provider 105 is on the transfer assembly 101, after importing fluid, the transfer assembly 101 moves away from the vent 202 (or the product 200) and drives the extract head 12 and film provider 105 to move away from the vent 202, thereby tearing off the breathable film 1531. That is, when the transfer assembly 101 moves away from the product 200, this separates the extract head 12 and tears off the breathable film 1531, no extra tearing film processes are needed. Comparing to traditional sticking and tearing film processes, sticking film station and tearing film station may be omitted, which may save a time for importing the fluid and increase an efficiency of importing the fluid and a use ratio of the apparatus 100.

In at least one embodiment, the apparatus 100 further includes a display 100*a* for displaying data of detected. The display 100*a* may display information as to detection, air extracting time, and products with fluid imported in real time, for monitoring fluid import time, the pressure inside the chamber 203 during air extraction, the pressure between the breathable film 1531 and the vent 202, and the positions of the breathable film 1531. The detected information may be for example the first pressure value detected by the first pressure sensor 103, the second pressure value detected by the second pressure sensor 104, and the reflection of light detected by the photoelectric sensor 154.

The workbench 300 is for placing the product 200 to be processed and cooperating with the transfer assembly 101, the air extractor 102, the film provider 105, and the importing assembly 106 for importing fluid to and extracting air from the product 200.

Referring to FIG. 3, the apparatus 100 further includes a controller 107, a storage 108, an I/O interface 109, and a communication bus 110. The controller 107 is coupled to the transfer assembly 101, the air extractor 102, the first pressure sensor 103, the second pressure sensor 104, the film provider 105, the importing assembly 106, the storage 108, and the I/O interface 109 through the communication bus 110.

In at least one embodiment, the controller 107 is coupled to the second pressure sensor 104, the importing assembly 106, and the air extractor 102. The second pressure sensor 104 detects the pressure in the chamber 203 of the product 200 to generate the second pressure value, and further transmits the second pressure value to the controller 107 through the communication bus 110, thus the controller 107 controls the operations of the air extractor 102 and the importing assembly 106 according to the second pressure value. For instance, the controller 107 controls the air extractor 102 start or stop the extraction of air according to at least one second pressure value, or controls the importing assembly 106 start or stop importing fluid according to at least one second pressure value.

In other embodiments, the second pressure sensor 104 is coupled to the air extractor 102. The air extractor 102 further includes a first controller coupled to the second pressure sensor 104. The air extractor 102 starts or stops air-extracting according to at least one second pressure value. In other embodiments, the second pressure sensor 104 is coupled to the importing assembly 106. The importing assembly 106 further includes a second controller coupled to the second pressure sensor 104. The importing assembly 106 starts or stops importing fluid according to at least one second pressure value.

The first controller and the second controller may be independent control components or a part of the controller 107 (integrated in the controller 107) for controlling different modules. In at least one embodiment, the controller 107 is coupled to the first pressure sensor 103. The first pressure sensor 103 detects the pressure between the extract head 12 and the breathable film 1531 to generate the first pressure value in electronic signal form or digital signal form, and further transmits the first pressure value to the controller 107 through the communication bus 110, thus the controller 107 adjusts the position of the transfer assembly 101. In at least one embodiment, the controller 107 is coupled to the photoelectric sensor 154, the photoelectric sensor 154 receives reflection of light and generates reflection value in electronic signal form or digital signal form, and further transmits the reflection value to the controller 107 through the communication bus 110, thus the controller 107 controls the rotation of the tape feeder 153 according to the reflection value, so the breathable film 1531 is positioned between the extract head 12 and the vent 202.

The controller 107 is coupled to the transfer assembly 101 for controlling the transfer assembly 101 to vertically move relative to the product 200 to press on the breathable film 1531 or tear off the breathable film 1531 from the vent 202. In at least one embodiment, the controller 107 is coupled to the slide driver for driving the slide shelf 111*a* together with the extract head 12 to move towards the vent 202, so the extract head 12 presses the breathable film 1531 to the vent 202 or tears the breathable film 1531 from the vent 202. In other embodiments, the controller 107 controls the extract head 12 to elastically latch to the vent 202. In other embodiments, the controller 107 controls the transfer assembly 101 to vertically move relative to the product 200 to press the breathable film 1531 for covering the vent 202

In at least one embodiment, the controller 107 controls the extract head 12 to press the breathable film 1531 to protrude into the vent 202 for improving airtightness of the breathable film 1531.

The controller 107 is coupled to the film provider 105 and the photoelectric sensor 154. The controller 107 controls the tape feeder 153 to move, so the breathable film 1531 on the tape feeder 153 is positioned between the extract head 12 and the vent 202. In detail, the controller 107 is coupled to the roller 152 for controlling the roller 152 to rotate the tray holder 151 according to the reflection value from the photoelectric sensor 154. When the photoelectric sensor 154 detects the second holes 153*a*, the first holes 1532*a* of the breathable film 1531 are above the vent 202 and are defaulted, at this time the controller 107 controls the roller 152 stop rotating the tape feeder 153 and controls the transfer assembly 101 to move, so the extract head 12 presses the breathable film 1531 to the vent 202.

The controller 107 may be a central processing unit (CPU), a microprocessor, an application-specific integrated circuit (ASIC), or one or more integrated circuit (IC) for controlling the aforesaid processes. In at least one embodiment, the controller 107 and the storage 108 may be integrated in a chip, the controller 107 is coupled to the transfer assembly 101, the air extractor 102, the first pressure sensor 103, the second pressure sensor 104, the film provider 105, the importing assembly 106, the storage 108, and the I/O interface 109 through the communication bus 110. In other embodiments, the controller 107 and the storage 108 may be independent components, the controller 107 is coupled to the transfer assembly 101, the air extractor 102, the first pressure sensor 103, the second pressure sensor 104, the film provider 105, the importing assembly 106, the storage 108, and the I/O interface 109 through wireless networks, such as wireless LAN, BLUETOOTH, Near Field Communication (NFC), and WI-FI, for transmitting information/signals and controlling fluid importing, air extracting, and tearing film.

The storage 108 may store information, receive the pressure values from the controller 107, and information generated during operations of the controller 107. The storage 108 can be used to store program codes of computer readable programs and various data. The storage 108 can include a read-only memory (ROM), a random access memory (RAM), a programmable read-only memory (PROM), an erasable programmable read only memory (EPROM), a one-time programmable read-only memory (OTPROM), an electronically-erasable programmable read-only memory (EEPROM), a compact disc read-only memory (CD-ROM), or other optical disk storage, magnetic disk storage, magnetic tape storage, or any other storage medium readable by the apparatus 100. The storage 108 may be an independent component and communicating with a processor or the controller 107. The storage 108 may be integrated with the processor. In at least one embodiment, the storage 108 stores pressure information including a first predetermined threshold value of the first pressure sensor 103, a second predetermined threshold value of the second pressure sensor 104, and a third predetermined threshold value of the photoelectric sensor 154. The I/O interface 109 may be a man-machine interaction interface of the apparatus 100 and configured to receive input and display information. The I/O interface 109 may include an input interface and an output interface. The input interface may be communicating with the controller 107 and receive inputs in different ways by the operator. For instance, the input interface may be a mouse, a keyboard, a touch screen, and/or a sensitive device. The output interface may be communicating with the controller 107 and display information in different ways. For instance, the output interface may be a liquid crystal display (LCD), a light emitting diode (LED), a cathode ray tube (CRT), and/or a projector.

The communication bus 110 forms an information path and is configured to transmit information among the transfer assembly 101, the air extractor 102, the first pressure sensor 103, the second pressure sensor 104, the film provider 105, and the importing assembly 106.

Figure 7:
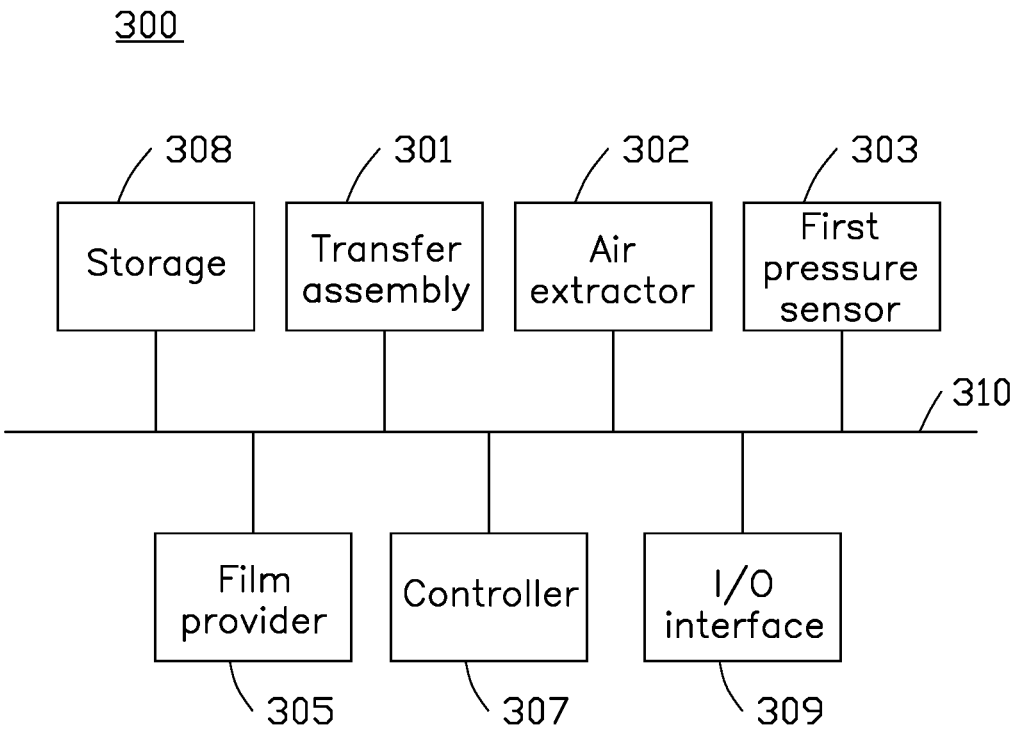
FIG. 7 illustrates a functional block diagram of at least one embodiment of an air extractor of the apparatus.

Referring to FIG. 7, an air extracting device 300 is configured to extract air from the product 200. The air extracting device 300 may be used cooperatively with the breathable film. The product includes filler and defines vents, the breathable film covers the vents. The air extracting device 300 includes a transfer assembly 301, an extract head, and a controller 307. The transfer assembly 301 is connected to the breathable film, the extract head is connected to the transfer assembly 301 and configured to extract air from the chamber through the breathable film and the vent. The controller 307 is coupled to the transfer assembly 301 and configured to control the transfer assembly 301 to vertically move relative to the surface of the product, so as to drive the extract head and the breathable film to separate from the vent.

In at least one embodiment, the extract head protrudes and forms an arc shape. Due to error of the went of the product 200, positions of the extract head and the vent in a vertical direction have micro errors. When the extract head move towards the vent, bevels of the protruded arc structure of the extract head contact an internal wall of the vent, extend along the bevels of the extract head, thus the extract head slides into the vent, thereby decreasing a positioning difficulty and times of the extract head, improving a precision and convenience of sealing the breathable film, and improving the airtightness of the extract head.

In at least one embodiment, the air extracting device 300 includes a film provider 305 providing a tape feeder. The breathable film is on the tape feeder. The film provider 305 is coupled to the controller 307. The controller 307 controls the tape feeder to move, so the breathable film is positioned between the extract head and the vents. Details of the film provider 305 can be taken from the description of the film provider 105.

In at least one embodiment, the air extracting device 300 includes an air extractor 302 including an extract head. The air extractor 302 is coupled to the controller 307. The controller 307 controls the extract head to move toward the vent, thus the extract head presses on the breathable film. Parts of the breathable film corresponding to the vents protrude into the vents, the breathable film covers the vents for improving airtightness of the vents.

In at least one embodiment, the air extracting device 300 includes a first pressure sensor 303 configured to detect a pressure of the extract head when pressed to the breathable film, to generate a first pressure value in electronic signal form or digital signal form. The first pressure sensor 303 transmits the first pressure value to the controller 307 through the communication bus 310. The controller 307 adjusts the positions of the transfer assembly 301 according to the first pressure value, so as to improve airtightness of the breathable film covering the vents.

In at least one embodiment, the air extracting device 300 includes a storage 308. Connection relationship of the communication bus 310, the I/O interface, the storage 308, the controller 307, and the air extractor 302 are shown in FIG. 7 and described above as in the FIG. 3. The structure of the air extracting device 300 may also be taken from the apparatus 100, as shown in FIGS. 1 and 2.

The transfer assembly 301 vertically moves away from the surface of the product, thus the extract head and the breathable film separate from the vents, which prevents the filler in the chamber overflowing to the surface of the product, meanwhile tearing film devices may be omitted, which may increase an efficiency of importing the fluid and a use ratio of the air extracting device 300.

In another embodiment, the air extracting device may be used cooperatively with a breathable cover. The air extracting device includes a transfer assembly, an extract head, and a controller. The breathable cover covers the extract head. The extract head protrudes and form an arc shape. The extract head is connected to the transfer assembly and configured to extract air from the chamber through the breathable cover and the vent. The controller is coupled to the transfer assembly and configured to control the transfer assembly to vertically move relative to the surface of the product, so as to drive the extract head and the breathable cover to separate from the vent.

In another embodiment, the air extracting device includes a transfer assembly, an extract head, and a controller. The breathable cover covers the extract head. The extract head protrudes and forms an arc shape. An air inlet of the extract head includes a breathable portion for transmitting air but stopping fluid. The extract head is connected to the transfer assembly 301 and configured to extract air from the chamber through the breathable cover and the vent. The controller 307 is coupled to the transfer assembly 301 and configured to control the transfer assembly 301 to vertically move relative to the surface of the product, so as to drive the breathable portion of the extract head to separate from the vent.

In another embodiment, an apparatus is provided for importing fluid into an interior chamber of a product. The product defines a vent communicating with the chamber. The apparatus for importing fluid further includes:

an extract head, configured to extract air from the chamber through the vent;

a transfer assembly, connected to the extract head and configured to drive the extract head to move towards the product, so the extract head covers the vent;

the extract head includes an air inlet, and a first cross section and a second cross section in parallel. The second cross section is between the first cross section and the air inlet, an area of the first cross section is greater than an area of the second cross section, the area of the first cross section is greater than or equal to an area of the vent. In at least one embodiment, the first cross section and the second cross section are virtual sections, describing the structure of the extract head.

Due to the second cross section being between the first cross section and the air inlet, an area of the first cross section is greater than an area of the second cross section, so a periphery of the extract head is increasing from an end with the air inlet to other end, when the transfer assembly drives the extract head to move towards the vent, the protruded arc structure of the extract head slides along an internal wall of the vent, thus the extract head slides into the vent, thereby decreasing a positioning difficulty and times of the extract head, no extra positioning devices are needed, and improving a precision and convenience of sealing the breathable film. Besides, the air inlet of the extract head is positioned in the vent, so the fluid may not overflow through the breathable film to the surface of the product.

In at least one embodiment, the extract head protrudes and forms an arc shape. The extract head further includes an elastic portion. The transfer assembly drives the extract head to move towards the product, to as to drive the elastic portion to move towards the vent. When the extract head moves towards the vent together with the transfer assembly, the extract head has space by elastic deformation, which is good for positioning the extract head to the vent and improving the airtightness between the extract head and the vent. Besides, hard contact between the extract head and the vent may be prevented, so as to protect the product.

In at least one embodiment, the extract head may be used cooperatively with the breathable film. The extract head presses the breathable film, so parts of the breathable film corresponding to the vents protrude into the vents.

Figure 8:
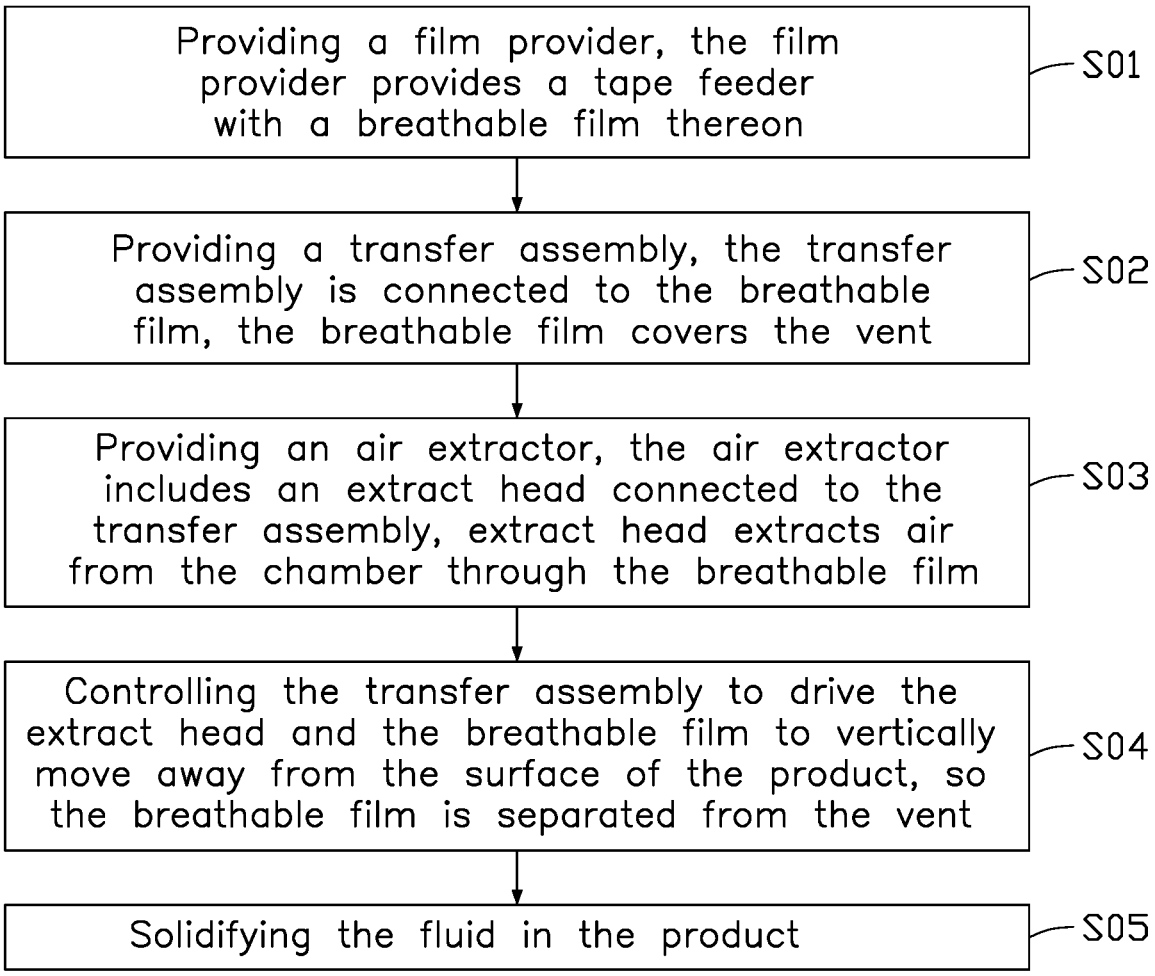
FIG. 8 illustrates a flowchart of at least one embodiment of a method of the apparatus for tearing a film.

FIG. 8 illustrates a flowchart of at least one embodiment of a method for importing fluid applied in the apparatus 100. The method is provided by way of example, as there are a variety of ways to carry out the method. Each block shown in FIG. 8 represents one or more processes, methods, or subroutines carried out in the example method. Furthermore, the illustrated order of blocks is by example only and the order of the blocks can be changed. Additional blocks may be added or fewer blocks may be utilized, without departing from this disclosure. The example method can begin at block S01. The method includes:

At block S01, providing a film provider, the film provider provides a tape feeder with a breathable film thereon.

In at least one embodiment, the tape feeder includes a breathable film and a base layer. The breathable film is overlapped on the base layer. The base layer defines a plurality of first holes arranged alternately (the first hole throughout the base layer), every two neighboring first holes have a same distance. The first hole exposes the breathable film. The tape feeder defines a plurality of second holes.

Every two neighboring second holes have a same distance. The second holes throughout the breathable film and the base layer and configured to positioning the tape feeder through a photoelectric sensor. The second holes and the first holes are arranged spaced one by one, that is opposite sides of each first hole are two second holes.

At block S02, providing a transfer assembly, the transfer assembly is connected to the breathable film, the breathable film covers the vent.

At block S03, providing an air extractor, the air extractor includes an extract head connected to the transfer assembly, extract head extracts air from the chamber through the breathable film.

In at least one embodiment, the transfer assembly 101 drives the extract head to press the breathable film to the vent, thus no extra sticking film process or devices are needed, the breathable film covers the vent while the extract head contacts the vent. In other embodiments, the breathable film may be manually sticked the vent, the breathable film may be on the tape feeder, the tape feeder is on the film provider, the breathable film covers the vent through the transmission of the tape feeder and the press of the extract head.

At block S04, controlling the transfer assembly to drive the extract head and the breathable film to vertically move away from the surface of the product, so the breathable film is separated from the vent.

In at least one embodiment, when the extract head presses the breathable film on the vent, the extract head extracts air from the chamber through the first holes, the breathable film and the vent.

In at least one embodiment, the surface of the product may be a plane or a hook face. When the surface of the product being a plane, the transfer assembly vertically move relative to the surface of the product. When the surface of the product being a hook face, the transfer assembly vertically move relative to a tangent plane of the hook face.

In at least one embodiment, the transfer assembly drives the extract head and the breathable film to vertically move away from the surface of the product, so the breathable film is separated from the vent, which means the transfer assembly drive the breathable film to move along a first direction, so the breathable film separates from the vent. The first direction may be corresponding to or parallel to an axis of the extract head. In addition, the transfer assembly drives the breathable film to move along a second direction, so the breathable film closes to the vent (when air extraction starts). The second direction may be corresponding to or parallel to an axis of the extract head. That is, the second direction is parallel to the first direction, but in opposite. Due to the extract direction is along the axis of the extract head, the extract head fits to the product, when the transfer assembly drives the breathable film to move along the first direction, preventing the fluid moving with the breathable film, so as to decrease a probability of pollution to the product.

In at least one embodiment, the moving means the product keeps still, and the transfer assembly drives the breathable film to move. In other embodiments, the moving means the product moves, but the transfer assembly keeps still. In other embodiments, the product may be position in a movable portion, the transfer assembly keeps still, the movable portion in a direction perpendicular to the surface of the product and away from the breathable film, thus the product may separate from the breathable film, so as to tear the breathable film, thus no extra tearing film process are needed before or after unloading the product.

In at least one embodiment, after the transfer assembly drives the extract head and the breathable film to move, so the breathable film separates from the vent, controlling the transfer assembly to drive the extract head to move away from the breathable film. That is, the separation of the extract head and the breathable film happens after leaving the vent, so as to prevent any breathable film shakes when the extract head separates from the breathable film which may be disadvantage of tearing the breathable film.

At block S05, solidifying the fluid in the product.

In at least one embodiment, block S05 is after block S04, that is, the separation of the breathable film and the vent is before the fluid is solidified.

The method of tearing the breathable film may tear the breathable film along the direction perpendicular to the surface of the product, thus to efficiently prevent the breathable film stained with the fluid. Even though the breathable film is stained with the fluid, the fluid may drop into the vent due to the gravity and may not overflow to the surface of the product, thus to efficiently prevent the fluid polluting the surface of the product when tearing the breathable film. Besides, tearing the breathable film while moving the extract head away from the vent, which saving the time and improving automaticity, the efficiency of importing fluid, and usage ratio of the apparatus.

Figure 9:
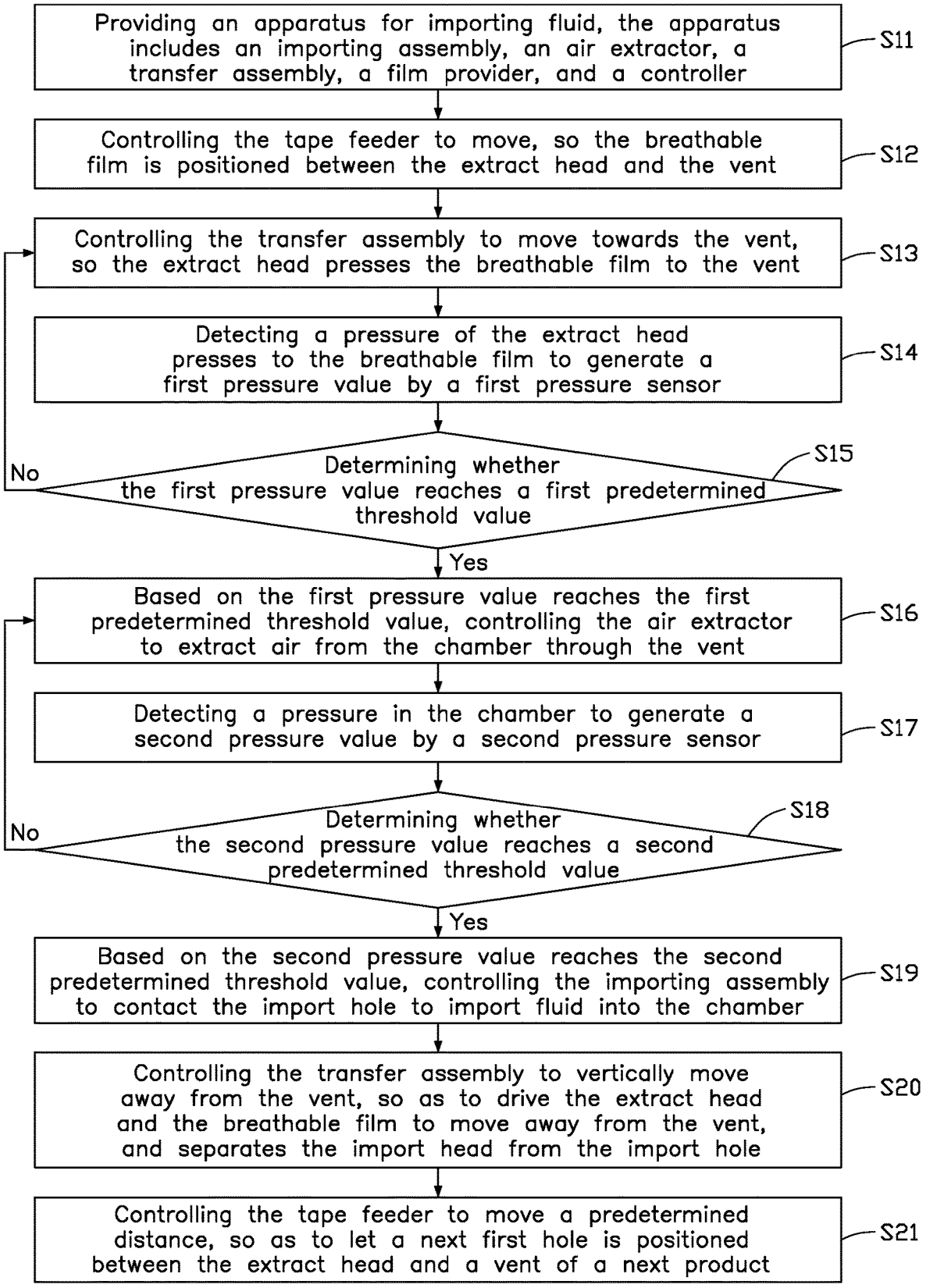
FIG. 9 illustrates a flowchart of at least one embodiment of a method for importing fluid.

FIG. 9 illustrates a flowchart of at least one embodiment of a method for importing fluid. The method is provided by way of example, as there are a variety of ways to carry out the method. Each block shown in FIG. 9 represents one or more processes, methods, or subroutines carried out in the example method. Furthermore, the illustrated order of blocks is by example only and the order of the blocks can be changed. Additional blocks may be added or fewer blocks may be utilized, without departing from this disclosure. The example method can begin at block S11. The method for importing fluid includes:

At block S11, providing an apparatus for importing fluid, the apparatus includes an importing assembly, an air extractor, a transfer assembly, a film provider, and a controller. The controller is coupled to the importing assembly, the air extractor, the film provider, and the transfer assembly.

In at least one embodiment, the film provider provides a tape feeder with a breathable film thereon. The air extractor includes an extract head. The transfer assembly is connected to the extract head and the breathable film. The tape feeder includes a breathable film and a base layer. The breathable film is overlapped on the base layer. The base layer defines a plurality of first holes arranged alternately (the first hole throughout the base layer), every two neighboring first holes have a same distance. The first hole exposes the breathable film.

At block S12, controlling the tape feeder to move, so the breathable film is positioned between the extract head and the vent.

At block S13, controlling the transfer assembly to move towards the vent, so the extract head presses the breathable film to the vent.

In at least one embodiment, the extract head protrudes and form an arc shape. When the extract head presses the breathable film, parts of the breathable film corresponding to the vent protrudes towards the internal of the vent, so the breathable film tightly presses the vent and airtightness between the breathable film and the vent is improved. In this block, the transfer assembly move towards the vent, the extract head covers the vent meanwhile pressing the breathable film to the vent, so as to increase an efficiency of importing the fluid and a use ratio of the apparatus.

In at least one embodiment, the importing assembly includes an import head for importing fluid into the chamber through the import hole. The import head is connected to the transfer assembly. When the transfer assembly moves towards the vent, the import head moves towards the vent too. Thus, when the transfer assembly moves towards the vent, the extract head covers the vent meanwhile pressing the breathable film to the vent, the import head covers the vent.

At block S14, detecting a pressure of the extract head presses to the breathable film to generate a first pressure value by a first pressure sensor.

The first pressure sensor detects the pressure between the extract head and the breathable film to generate the first pressure value in electronic signal form or digital signal form, and further transmits the first pressure value to the controller through a communication bus.

At block S15, determining whether the first pressure value reaches a first predetermined threshold value. If the first pressure value reaches the first predetermined threshold value, block S16 is processed. Otherwise, the method returns to block S13.

The first predetermined threshold value is stored in a storage, the controller receives the first pressure value from the first pressure sensor and invokes the first predetermined threshold value stored in the storage, so as to determine whether the first pressure value reaches a first predetermined threshold value. In at least one embodiment, a range of the predetermined threshold value may be about 0.8-3 N.

In other embodiments, if the first pressure value is greater than the first predetermined threshold, controlling the transfer assembly to drive the extract head to move away from (releases) the vent, until the value reaches the predetermined threshold value range. Therefore, the product 200 is protected from over pressure.

At block S16, based on the first pressure value reaches the first predetermined threshold value, controlling the air extractor to extract air from the chamber through the vent.

After extracting air from the chamber by the air extractor, air in the chamber decreases, thus the chamber forms a negative pressure environment.

At block S17, detecting a pressure in the chamber to generate a second pressure value by a second pressure sensor.

The second pressure sensor detects the pressure in the chamber to generate the second pressure value in electronic signal form or digital signal form, and further transmits the second pressure value to the controller through the communication bus. The block S16 may be continuously operated in block S17, that is, detecting the second pressure value while extracting air.

At block S18, determining whether the second pressure value reaches a second predetermined threshold value. If the second pressure value reaches the second predetermined threshold value, block S19 is processed. Otherwise, the method returns to block S17.

The second predetermined threshold value is stored in the storage, the controller receives the second pressure value from the second pressure sensor and invokes the second predetermined threshold value stored in the storage, so as to determine whether the second pressure value reaches the second predetermined threshold value.

At block S19, based on the second pressure value reaches the second predetermined threshold value, controlling the importing assembly to contact the import hole to import fluid into the chamber.

In at least one embodiment, the controller controls the transfer assembly to vertically move towards the product, so the import head contact the import hole, the extract head presses the breathable film to the vent, when the extract head extracts air from the chamber through the breathable film, meanwhile drives the import head to contact the import hole, after the first pressure value is corresponding to the first predetermined threshold value and the second pressure value is corresponding to the second predetermined threshold value, importing fluid into the chamber, so as to improve the efficiency.

At block S20, controlling the transfer assembly to vertically move away from the vent, so as to drive the extract head and the breathable film to move away from the vent, and separates the import head from the import hole.

After importing fluid, to prevent the fluid from being stained with the breathable film that may make the breathable film difficult to be separated, before the breathable film separates from the vent, do not solidifying the fluid, that may be good for tearing the breathable film. By controlling the transfer assembly to vertically move away from the vent, to efficiently prevent the breathable film stained with the fluid. Even though the breathable film is stained with the fluid, the fluid may drop into the vent due to the gravity and may not overflow to the surface of the product, thus to efficiently prevent the fluid polluting the surface of the product when tearing the breathable film. Meanwhile the importing assembly imports fluid, the second pressure sensor continuously detects the pressure in the chamber and generates the second pressure value, the controller determining whether the second pressure value reaches the second predetermined threshold value, the second pressure value is a pressure after fluid imported. When the second pressure value reaches the second predetermined threshold value, controller controls the importing assembly to stop importing fluid into the chamber.

In at least one embodiment, the method further includes solidifying the product. After the import head separates from the import hole and the extract head and the breathable film separates from the vent, heating and solidifying the product.

In at least one embodiment, the method is applied for importing fluid into several products, the method for importing fluid further includes:

At block S21, controlling the tape feeder to move a predetermined distance, so as to let a next first hole is positioned between the extract head and a vent of a next product.

Block S21 may import fluid for the next product.

In block S21, controlling the tape feeder in the film provider to move, and detecting reflection of lights transmitted to the tape feeder and generating reflection value by a photoelectric sensor. The photoelectric sensor detects reflection of lights transmitted to the tape feeder and generates reflection value in electronic signal form or digital signal form, and further transmits the reflection value to the controller through the communication bus. A predetermined threshold value of the reflection value (hereinafter a third predetermined threshold value) is stored in the storage. The controller receives the reflection value from the photoelectric sensor and invokes the third predetermined threshold value, and compares the reflection value to the third predetermined threshold value, to determine whether the reflection value reaches the third predetermined threshold value. If so, the controller controls the film provider to stop moving, to position a next breathable film on the tape feeder between the extract head and the vent of a next product. If not, the controller controls the film provider to continuously move, until the reflection value detected by the photoelectric sensor reaches the third predetermined threshold value.

The method for importing fluid using traditional apparatus adds sticking film and tearing film processes in traditional fluid importing process. That is, pressing the breathable film to the vent while loading the extract hand to the vent and tearing the breathable film from the vent while separating the extract hand from the vent, no extra time needed, which may increase an efficiency of importing the fluid and a use ratio of the apparatus.

In another embodiment, the method is applied for importing fluid into several products, the method for importing fluid further includes:

controlling the tape feeder to move a predetermined distance by the controller, the photoelectric sensor detects reflection of lights transmitted to the tape feeder and generates reflection value in electronic signal form or digital signal form, the controller compares the reflection value to the third predetermined threshold value. If the reflection value reaches the third predetermined threshold value, meaning that a next breathable film on the tape feeder is positioned between the extract head and the vent of a next product. If the reflection value does not reach the third predetermined threshold value, generating indication, meaning that a next breathable film on the tape feeder is not positioned between the extract head and the vent of a next product, which needs recheck.

In another embodiment, the method is applied for importing fluid into several products, the method for importing fluid further includes:

controlling the tape feeder to move a predetermined distance by the controller, the photoelectric sensor detects reflection of lights transmitted to the tape feeder and generates reflection value in electronic signal form or digital signal form, the controller compares the reflection value to the third predetermined threshold value. If the reflection value reaches the third predetermined threshold value, meaning that a next breathable film on the tape feeder is positioned between the extract head and the vent of a next product. If the reflection value does not reach the third predetermined threshold value, controlling the tape feeder to move another predetermined distance by the controller, the photoelectric sensor detects reflection of lights transmitted to the tape feeder and generates reflection value in electronic signal form or digital signal form, the controller compares the reflection value to the third predetermined threshold value again, if the reflection value does not reach the third predetermined threshold value, generating indication, meaning that a next breathable film on the tape feeder is not positioned between the extract head and the vent of a next product, which needs recheck.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure as defined by the appended claims.

What is claimed is:

1. An apparatus for importing fluid into a product and tearing a breathable film covered on the product, the product defining a vent in a surface, the product comprising a chamber communicated with the vent, the fluid imported into the chamber, the breathable film covering on the vent, the apparatus comprising:

a transfer assembly, connected to the breathable film, the transfer assembly comprising a slide assembly and a shelf, the shelf connected to the slide assembly;

an air extractor, comprising an extract head connected to the shelf, the extract head configured to extract air from the chamber through the breathable film and the vent; and a controller coupled to the transfer assembly and configured to control the slide assembly to drive the shelf and the air extractor to move vertically relative to the surface of the product to tear the breathable film from the vent;

the controller further configured to control the slide assembly to drive the shelf and the air extractor to move the extract head and the breathable film vertically away from the surface of the product to separate the breathable film from the vent.

2. The apparatus according to claim 1, wherein the controller is further configured to control the slide assembly to drive the air extractor to move vertically towards the surface of the product to press the breathable film on the vent by the extract head.

3. The apparatus according to claim 1, wherein:

the transfer assembly further comprises a press head configured to press the breathable film, the press head is connected to the shelf; and wherein the controller is further configured to control the slide assembly to drive the shelf to move vertically towards the surface of the product to press the breathable film covering the vent by the press head.

4. The apparatus according to claim 1, wherein:

the extract head comprises an air inlet, a first cross section, and a second cross section;

the first cross section and the second cross section are in parallel;

the second cross section is between the first cross section and the air inlet; and an area of the first cross section is greater than that of the second cross section.

5. The apparatus according to claim 4, wherein the extract head has an arc shape.

6. The apparatus according to claim 4, wherein the area of the first cross section is greater than or equal to an area of the vent.

7. The apparatus according to claim 1, wherein:

the extract head further comprises an elastic portion; and the controller is further configured to control the slide assembly to drive the air extractor to move vertically towards the surface of the product to drive the elastic portion to close to the vent.

8. The apparatus according to claim 1, further comprising:

a film provider, configured to provide a tape feeder, wherein:

the breathable film is on the tape feeder;

the film provider is coupled to the controller; and the controller is further configured to control the tape feeder to move to cover the breathable film on the vent.

9. The apparatus according to claim 1, wherein:

the controller is coupled to the air extractor;

the controller is further configured to control the extract head to move towards the product to press the breathable film covering the vent by the press head; and parts of the breathable film corresponding to the vent is pressed into the vent by the extract head.

10. The apparatus according to claim 1, wherein the controller is coupled to the air extractor, wherein the apparatus further comprises a first pressure sensor coupled to the controller and configured to detect a pressure of the extract head pressed to the breathable film to generate a first pressure value and transmit the first pressure value to the controller; and wherein the controller is further configured to adjust a position of the extract head based on the first pressure value.

11. An apparatus for importing fluid into a product, the product defining a vent and an import hole in a surface thereof, the apparatus comprising:

an air extractor comprising an extract head;

an importing assembly comprising an import head; and a transfer assembly comprising a slide assembly and a shelf, the shelf connected to the slide assembly, the shelf connected to the extract head of the air extractor and the import head of the importing assembly;

wherein the slide assembly is configured to contact with a breathable film and move the breathable film to cover the vent in the product, the air extractor is configured to press the breathable film onto the vent and extract air from the product through the vent and the breathable film, the import head is configured to import fluid into the import hole, and the slide assembly is configured to drive the extract head to move vertically relative to the surface of the product to remove the breathable film from the vent.

12. The apparatus according to claim 11, wherein the product further comprises a chamber communicated with the vent and the import hole, the import head is configured to import the fluid into the chamber through the import hole, the extract head is configured to extract air from the chamber through the breathable film and the vent, and the transfer assembly is further configured to drive the extract head to move vertically and away from the surface of the product to separate the breathable film from the vent.

13. The apparatus according to claim 12, further comprising a first pressure sensor and a second pressure sensor, wherein the first pressure sensor is configured to detect a pressure of the extract head pressing to the breathable film to generate a first pressure value, the transfer assembly adjusts a position of the extract head according to the first pressure value, the second pressure sensor detecting a pressure in the chamber of the product to generate a second pressure value.

14. The apparatus according to claim 11, wherein:

the extract head comprises an air inlet, a first cross section, and a second cross section;

the first cross section and the second cross section are parallel to each other;

the second cross section is between the first cross section and the air inlet;

an area of the first cross section is greater than an area of the second cross section; and the area of the first cross section is configured greater than or equal to an area of the vent of the product.

15. The apparatus according to claim 11, wherein:

the extract head further comprises an elastic portion; and the transfer assembly is further configured to drive the elastic portion to move vertically and towards the vent.

16. The apparatus according to claim 11, further comprising:

a film provider comprising a tape feeder, wherein:

the tape feeder is configured to provide the breathable film; and the tape feeder is movable to cover the breathable film on the vent.

17. The apparatus according to claim 16, wherein the film provider further comprises:

a tray holder arranged on the transfer assembly and configured to hold the tape heeder;

a roller arranged on the transfer assembly and configured to drive the tray holder together with the tape feeder to rotate; and at least one guide wheel configured to guide the tape feeder to carry the breathable film to above the vent.

18. The apparatus according to claim 16, wherein the film provider further comprises:

a photoelectric sensor arranged on the transfer assembly and configured to detect positions of the tape feeder when the tape feeder is rotating.

19. The apparatus according to claim 11, wherein the importing assembly comprises:

a delivery pipe connected to the import head and the configured to contain the fluid; and a first driver connected to the delivery pipe and configured to drive the fluid in the delivery pipe to flow towards the import head.

20. An apparatus for importing fluid into a product and tearing a breathable film covered on the product, the apparatus comprising:

a transfer assembly comprising a slide assembly and a shelf, the shelf connected to the slide assembly;

an air extractor comprising an extract head connected to the shelf; and a controller coupled to the transfer assembly and configured to control the slide assembly to drive the shelf and the extract head to move vertically relative to the surface of the product to tear the breathable film;

the controller further configured to control the slide assembly to drive the shelf and the air extractor to move the extract head vertically away from the surface of the product to separate the breathable film from the product.

* * * * *